US007103934B1

(12) United States Patent
Hsu et al.

(10) Patent No.: US 7,103,934 B1
(45) Date of Patent: Sep. 12, 2006

(54) MULTIPURPOSE COMBINATION PLIERS

(76) Inventors: Eric Hsu, P.O. Box 697, Fongyuan City, Taichung County (TW) 420; Dale E. Bjerke, P.O. Box 697, Fongyuan City, Taichung Counyt (TW) 420

( * ) Notice: Subject to any disclaimer, the term of this patent is extended or adjusted under 35 U.S.C. 154(b) by 0 days.

(21) Appl. No.: 10/959,045

(22) Filed: Oct. 7, 2004

(51) Int. Cl.
*B25B 7/22* (2006.01)
*B25B 7/00* (2006.01)

(52) U.S. Cl. ..... 7/127; 7/125; 7/128; 81/300; 81/342; 81/418; 81/424.5; 81/427.5

(58) Field of Classification Search ..... 7/125, 7/127, 128; 81/300, 342, 418, 424.5, 427.5
See application file for complete search history.

(56) References Cited

U.S. PATENT DOCUMENTS 6,009,582 A * 1/2000 Harrison et al. ..... 7/118
6,226,822 B1 * 5/2001 Chen ..... 7/128

* cited by examiner

*Primary Examiner*—Joseph J. Hail, III
*Assistant Examiner*—Shantese McDonald

(57) ABSTRACT

A multipurpose combination pliers includes a first and second insulated handles alternately and movably joined together by a rivet, a toothed jaw at the fore end of each of the handles, a rectangular connector at the rear end of the first insulated handle for engaging a cylindrical box wrench thereon and a U-shaped connector on the rear end of the second insulated handle for rotatably engaged with a rectangular adapter which is able to engage a smaller box wrench and can be laterally rotated for about 180 degrees relative to the U-shaped connector, an arcuate electric cords stripper communicated with a internally threaded through hole at front portion of the pliers. The feature is that this disclosure not only performs clamping and stripping functions but also conducts as a box wrench to drive addition object.

3 Claims, 8 Drawing Sheets

MULTIPURPOSE COMBINATION PLIERS

BACKGROUND OF THE INVENTION

The present invention relates to household tools and more particularly to a multipurpose combination pliers which can or to unfasten be able to clamp object, to strip electric cords, to fasten a bolt and to be adapted as a wrench to drive things.

As shown in FIG. 1, a prior art combination pliers 10 comprises a pair of insulated handles 11 and 12 alternately and movably joined with a pivot 13 and each having a toothed jaw 111 and 121 at fore end which is usually to clamp object, to cut wire and/or to extract the nails. But it couldn't to be used to unfasten a bolt, to drive things and/or to strip electric cords do which other suitable tool are required. That is uneconomic and inconvenient.

SUMMARY OF THE PRESENT INVENTION

The present invention has a main object to provide a multipurpose combination pliers which can be used as a wrench to drive things.

Another object of the present invention is to provide a multipurpose combination pliers which forms an angle between a driving head and the wrench to which it drives so as to facilitate the operation of an user.

Further object of the present invention is to provide a multipurpose combination pliers which possesses both the electric cords stripping and the bolt fastening and unfastening functions.

Accordingly, the multipurpose combination pliers of the present invention comprises generally a pair first and a second insulated handles which are alternately and movably joined with each other and secured by a pivot. Each of the handles has a toothed jaw at fore end, a rectangular or a U-shaped connector at rear end for respectively driving a box wrench and a adapter thereon. An electric cords stripper abutting a screw fastener adjacent the fore end, so that the multipurpose combination pliers is capable to do more jobs than the prior art combination pliers.

The present invention will become more fully understood by reference to the following detailed description thereof when read in conjunction with the attached drawings.

DETAILED DESCRIPTION OF THE PREFERRED EMBODIMENT

Figure 1:
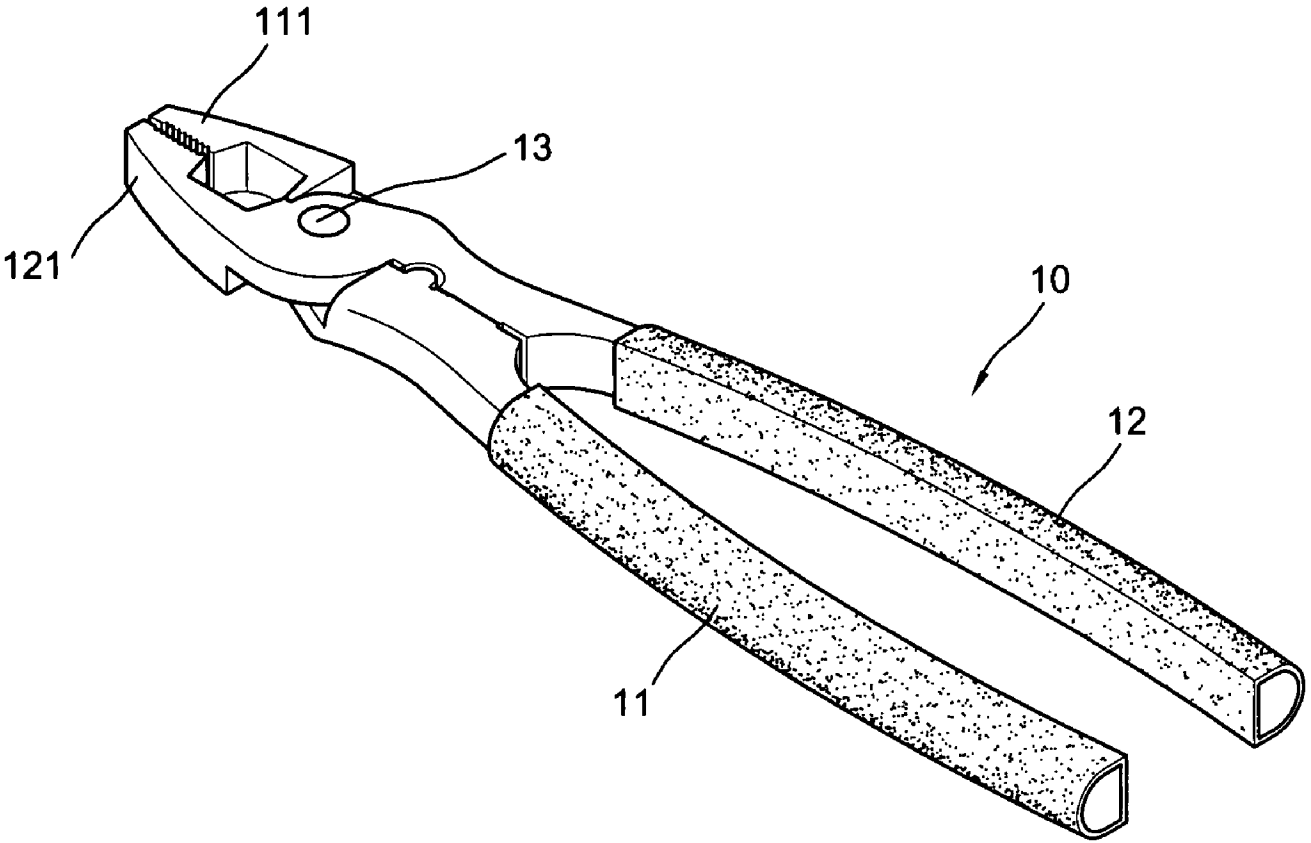
FIG.1 Prior Art
FIG. 1 is a perspective view of a combination pliers according to a prior art.
Figure 2:
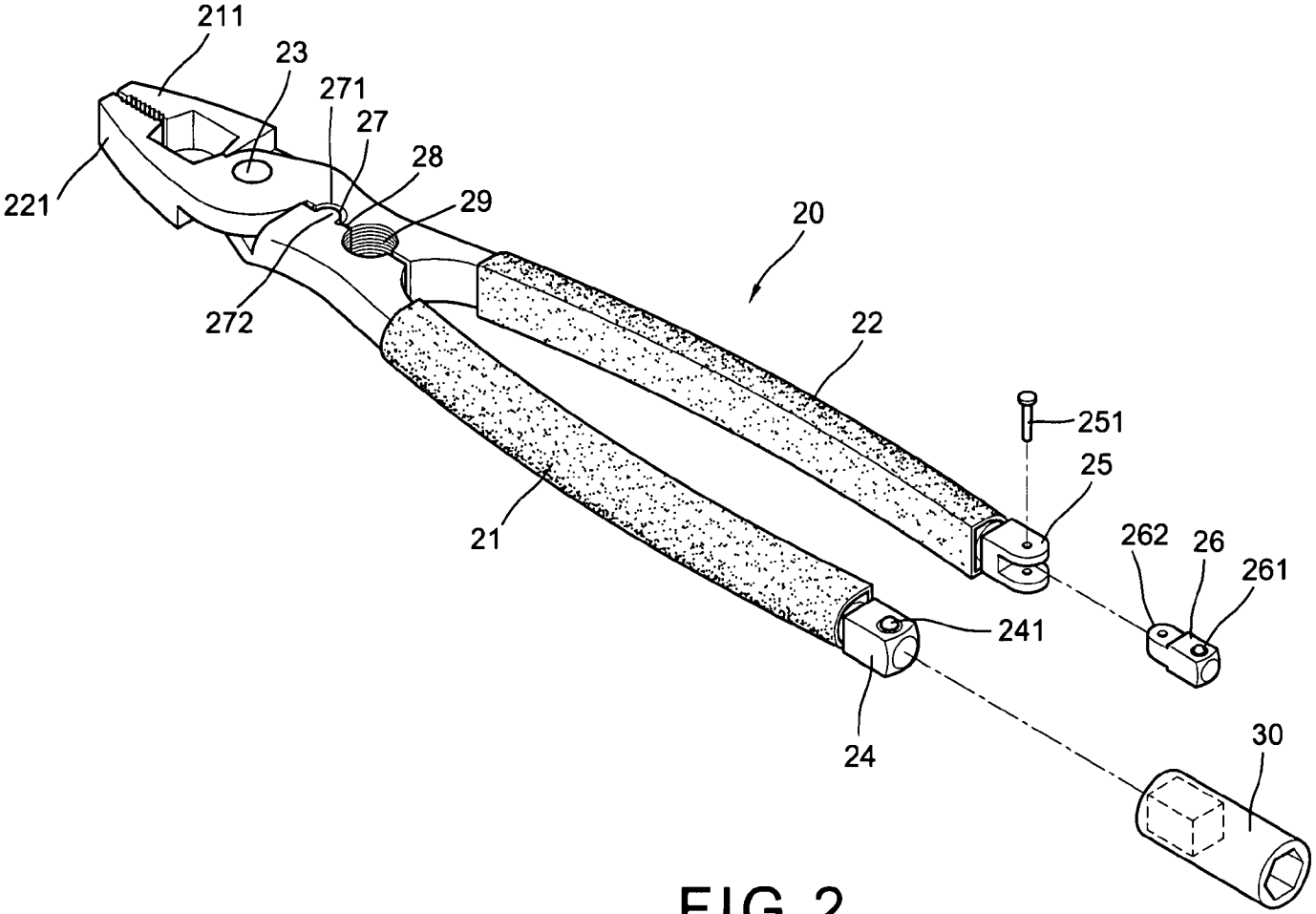
FIG. 2 is an exploded perspective view of a multipurpose combination pliers according to the present invention.
Figure 3:
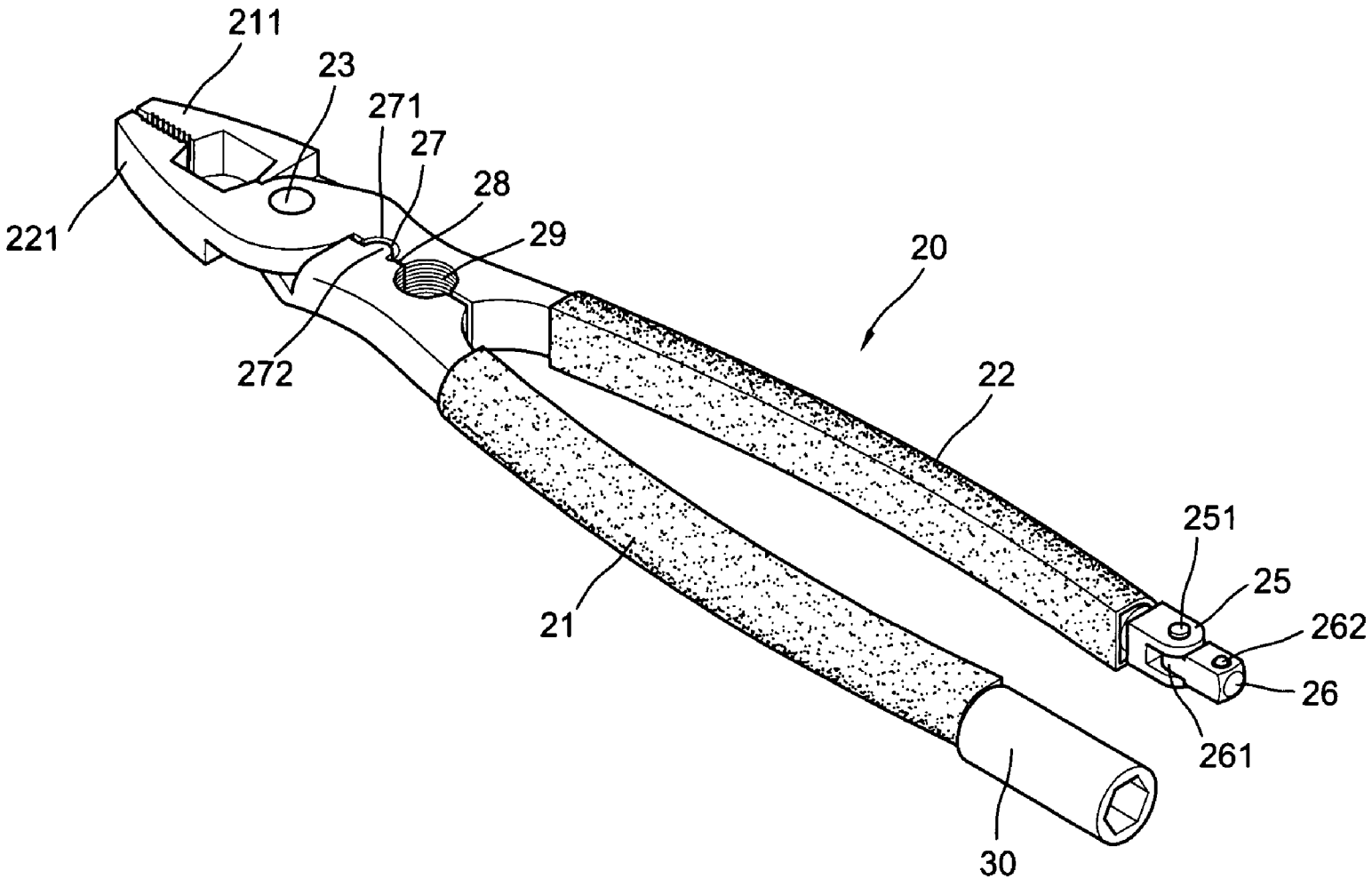
FIG. 3 is a perspective view to show the assembly of FIG. 2.
Figure 4:
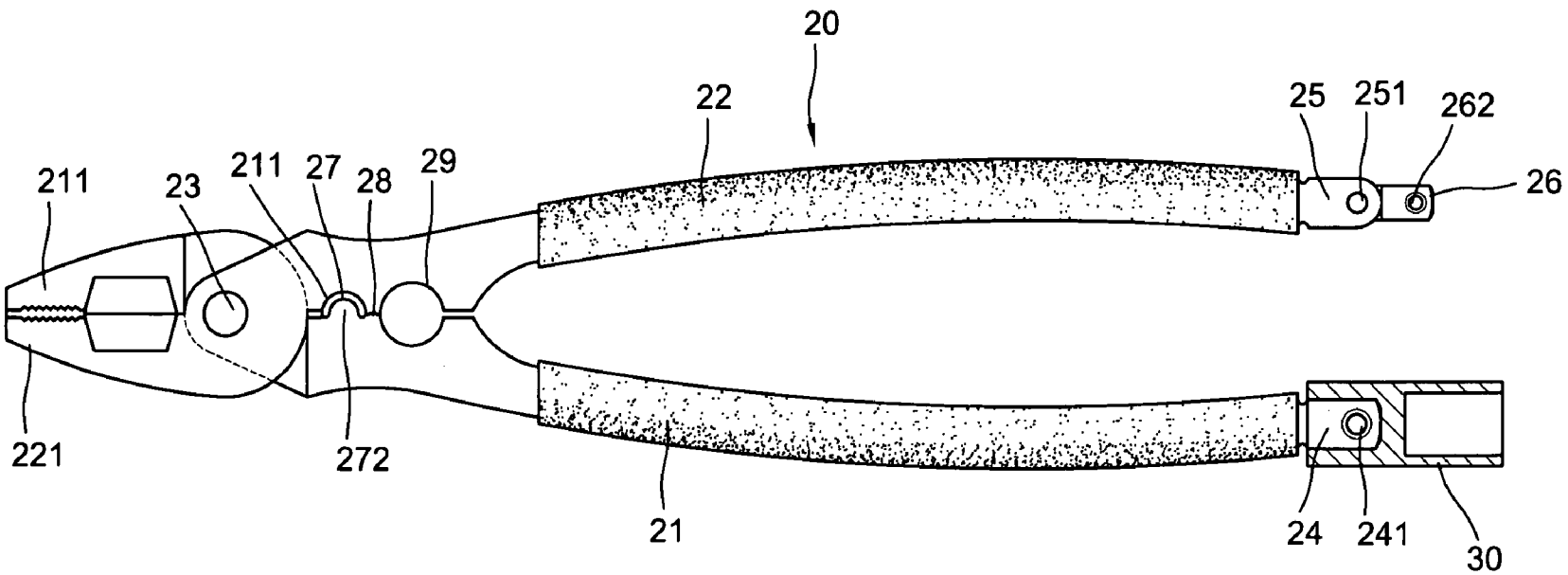
FIG. 4 is a perspective view and partially sectional view to show the connection of a box wrench with a rectangular connector.
Figure 5:
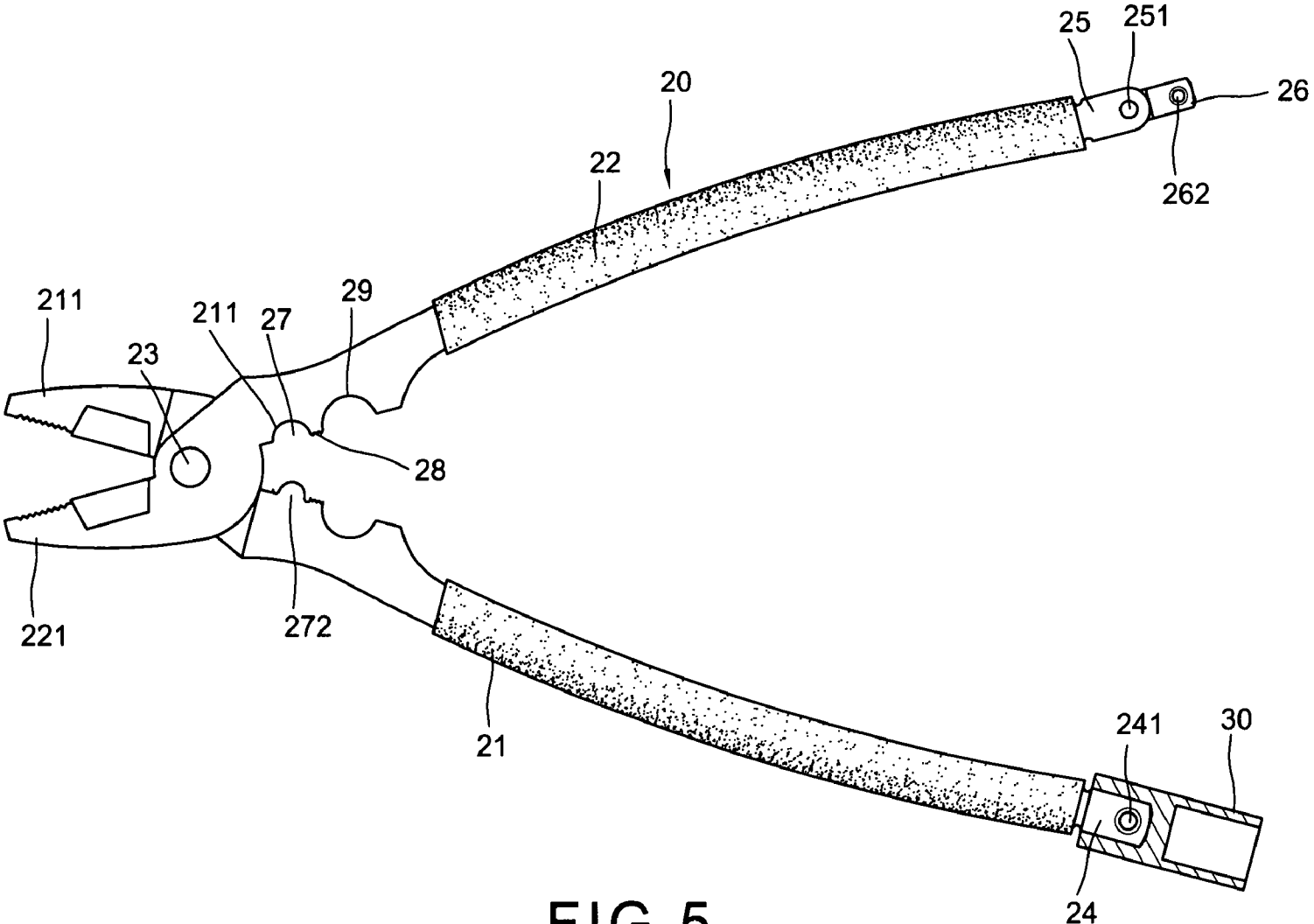
FIG. 5 is a plane view and partially sectional view to show the opening status of the pliers.
Figure 6:
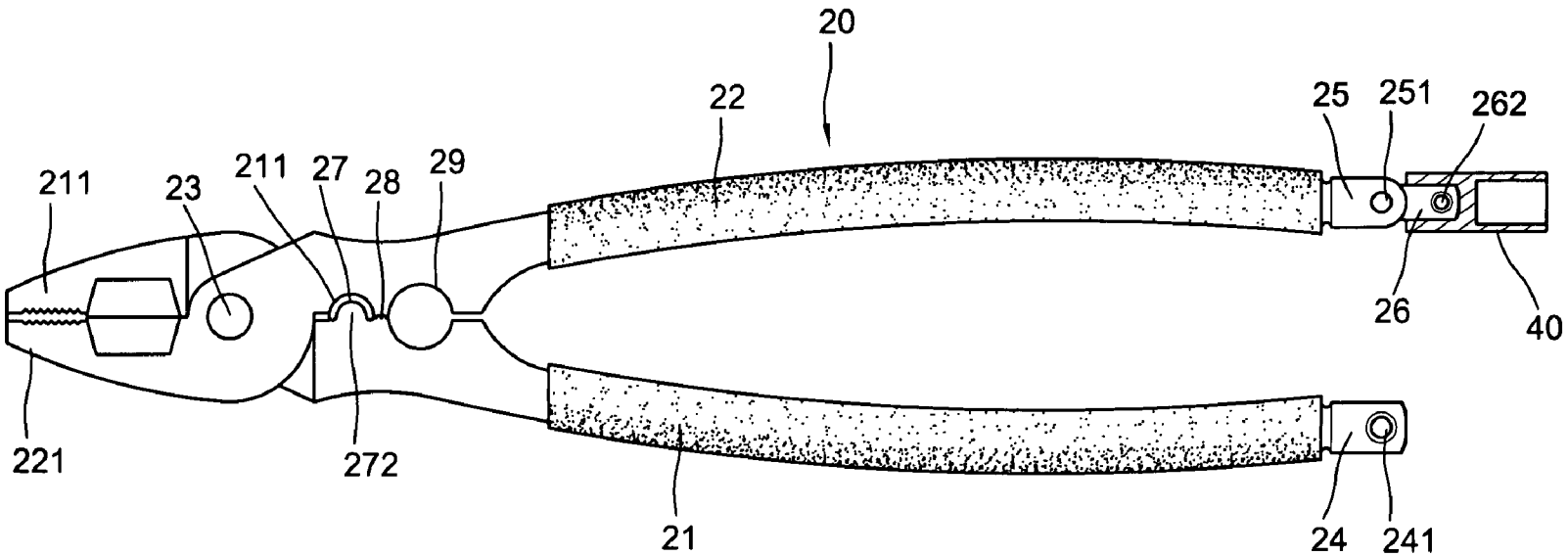
FIG. 6 is a plane view and partially sectional view to show that the box wrench is able to connect with an adapter.
Figure 7:
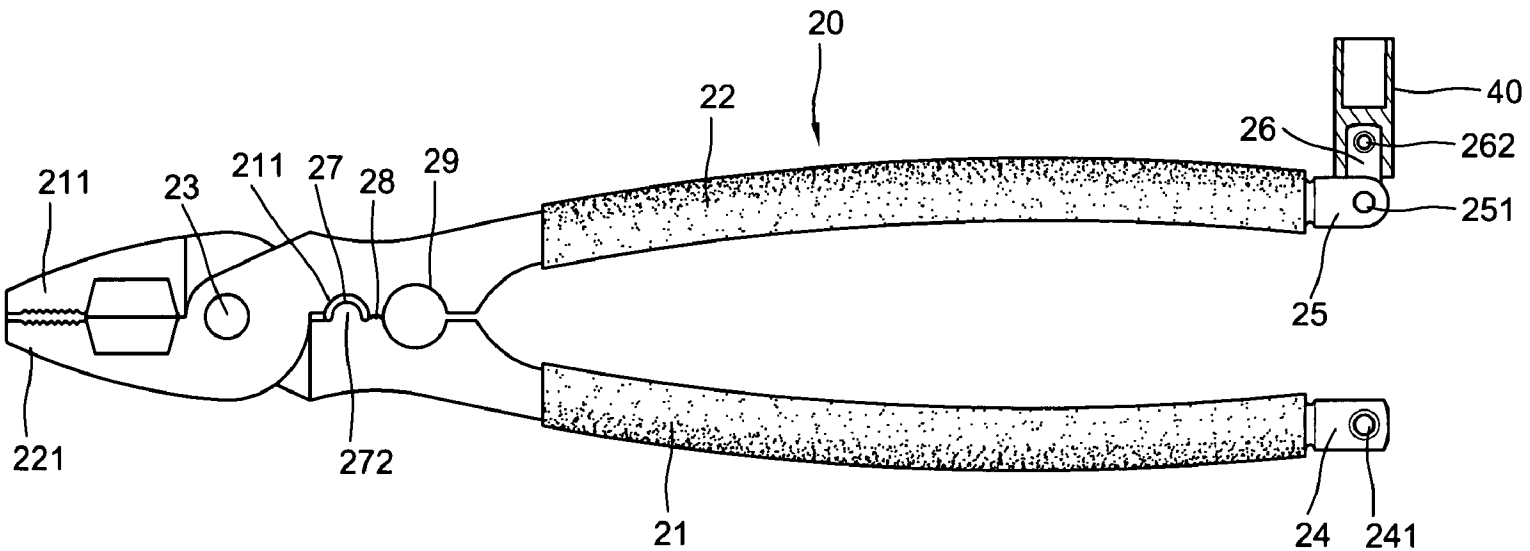
FIG. 7 is a plane view and partially sectional view indicating that the box wrench is rotated for about 90 degrees relative to the U-shaped connector.
Figure 8:
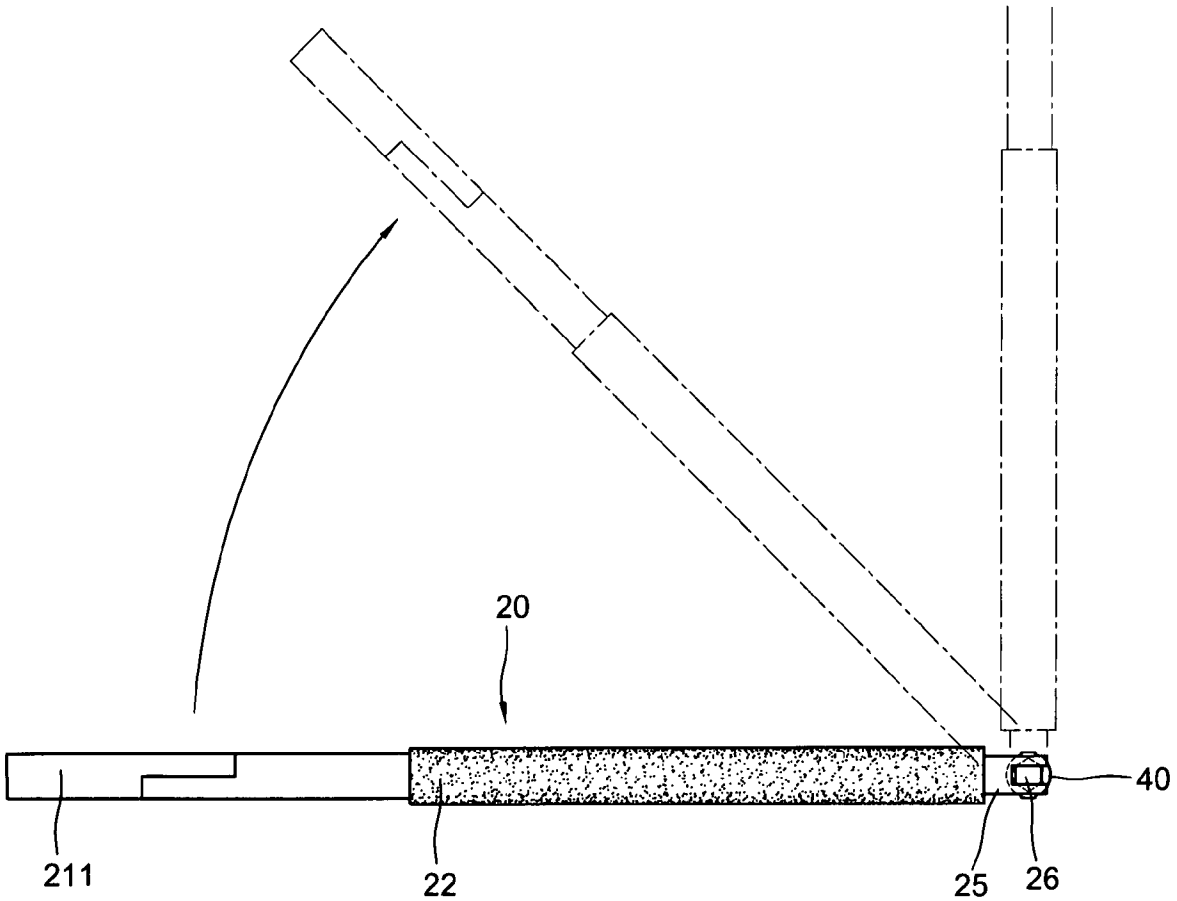
FIG. 8 is a plane view indicating that the box wrench is operated by the adapter.

With reference to the drawings and initiated from FIGS. 2, 3 and 4, the multipurpose combination pliers 20 of the present invention comprises a first and second insulated handles 21 and 22 alternately and movably joined with one another and secured by a pivot 23. The first insulated handle 21 has a first toothed jaw 211 at fore end, a rectangular connecter 24 at rear end including an elastic driving ball 241 in upper side and the second insulated handle 22 has an second toothed jaw 221 at fore end engageable with the first toothed jaw 211, a U-shaped connecter 25 at rear end including an aligned through hole 251 vertically formed adjacent free end, an arcuate electric cords stripper 27 adjacent the pivot 23 defined by an arcuate concaved blade 271 of the second insulated handle 22 and an arcuate convex blade 272 of the first insulated handle 21. A slit 28 and a internally threaded circular through hole 29 for clamping a threaded shank of a bolt abutting the stripper 27. The threaded circular through hole 29 is defined by a pair of semi-circular threaded depressions respectively formed in an inner side of the first and second insulated handles 21 and 22 (as shown in FIG. 5). A cylindrical box wrench 30 has a rectangular central bore in one end engageable with the rectangular connecter 24 a hexagonal depression in the other end for driving a hexagonal headed screw and/or the equivalent object. A rectangular adapter 26 has an elastic driving ball 261 in an upper side and a vertical through hole 262 in a reduced end engaged with the aligned through hole of the U-shaped connecter 25 and rotatably secured by a rivet 251. The adapter 26 is provided to drive a small sized box wrench 40 (as shown in FIG. 6) and capable of laterally rotated for about 180 degrees. FIG. 7 shows that the adapter 26 is rotated outward for about 90 degrees relative the U-shaped connecter 25 and FIG. 8 shows that the adapter 26 is also capable of driving a longer objects of those having similar rectangular recess in rear end.

Upon the above discussed structure, the multipurpose combination pliers 20 of the present invention uses the stripper 27 to cut the sheath of the electric cords and the slit 28 to clamp the cut off sheath and removing it from the electric cords which has been made a naked end portion, the internally threaded circular through hole 29 is to clamp the threaded shank of a bolt which will be extracted from an object and the rectangular connector 24 and/or the adapter 26 on the rear end of the insulated handles 21 and 22 to drive different sized box wrenches 30 and 40 for fastening or unfastening the hexagonal headed screws. Therefore saving the additional tools that provides great convenience to the users and increase the value of use of the products.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

We claim:

1. A multipurpose combination pliers comprising:

a first and second corresponding insulated handles, alternately and movably joined together and secured by a pivot, said first insulated handle having a first toothed jaw at a fore end and a rectangular connector at a rear end, said rectangular connector including a first elastic driving ball in an upper surface, said second insulated handle having a second toothed jaw at a fore end engageable with the first toothed jaw, and a U-shaped connecter at a rear end including a vertically aligned through hole therein;

a cylindrical box wrench having a rectangular central bore in one end and being engageable with the rectangular connecter, and a hexagonal depression in the other end;

a rectangular adapter having a second elastic driving ball in an upper surface and a vertical through hole in a reduced portion engaged with the aligned through hole of the U-shaped connector, and rotatably secured by a rivet;

an arcuate electric cord stripper adjacent the pivot, said electric cord stripper being defined by an arcuate concaved blade of said second insulated handle and an arcuate convex blade of said first insulated handle;

an internally threaded through hole defined by a pair of semi-circular depressions respectively formed in an inner side of said first and second insulated handles, and in communication with the arcuate electric cord stripper through a slit therebetween.

2. The multipurpose combination pliers as recited in claim 1, wherein said adapter can be able to rotate laterally for 180 degrees on the pivot of said U-shaped connector.

3. The multipurpose combination pliers as recited in claim 1, wherein said internally threaded through hole is suitable to engage with a threaded shank of a bolt for extracting said bolt from an object.

* * * * *